US007413533B2

(12) United States Patent
Lin

(10) Patent No.: US 7,413,533 B2
(45) Date of Patent: Aug. 19, 2008

(54) ADJUSTABLE DUMBBELL

(75) Inventor: William Lin, Taichung (TW)

(73) Assignee: ASAI Regent Limited, Taichung (TW)

( * ) Notice: Subject to any disclaimer, the term of this patent is extended or adjusted under 35 U.S.C. 154(b) by 166 days.

(21) Appl. No.: 11/350,169

(22) Filed: Feb. 8, 2006

(65) Prior Publication Data

US 2007/0184945 A1 Aug. 9, 2007

(51) Int. Cl.
*A63B 21/072* (2006.01)
*A63B 21/075* (2006.01)

(52) U.S. Cl. ..... 482/108; 482/107; 482/106

(58) Field of Classification Search ..... 482/106–108; *A63B 21/072, 21/075*
See application file for complete search history.

(56) References Cited

U.S. PATENT DOCUMENTS

| | | | | |
|---|---|---|---|---|
| 4,529,198 | A | 7/1985 | Hettick, Jr. | |
| 5,839,997 | A | 11/1998 | Roth et al. | |
| 5,876,313 | A | 3/1999 | Krull | |
| 6,039,678 | A | 3/2000 | Dawson | |
| 6,228,003 | B1 | 5/2001 | Hald et al. | |
| 6,261,022 | B1 | 7/2001 | Dalebout et al. | |
| 6,416,446 | B1 | 7/2002 | Krull | |
| 6,500,101 | B1 | 12/2002 | Chen | |
| 6,540,650 | B1 | 4/2003 | Krull | |
| 6,656,093 | B2 | 12/2003 | Chen | |
| 6,899,661 | B1 | 5/2005 | Krull | |
| 7,025,713 | B2 | 4/2006 | Dalebout et al. | |
| 7,090,625 | B2 | 8/2006 | Chermack | |
| 7,121,988 | B2 | 10/2006 | Walkerdine | |
| 7,137,932 | B2 * | 11/2006 | Doudiet | 482/107 |
| 7,223,214 | B2 * | 5/2007 | Chen | 482/107 |
| 2002/0183174 | A1 | 12/2002 | Chen | |
| 2003/0148862 | A1 * | 8/2003 | Chen et al. | 482/108 |
| 2004/0005969 | A1 | 1/2004 | Chen | |
| 2006/0105891 | A1 | 5/2006 | Cappellini et al. | |

* cited by examiner

*Primary Examiner*—Loan H. Thanh
*Assistant Examiner*—Ryan Durcik
(74) *Attorney, Agent, or Firm*—Pillsbury Winthrop Shaw Pittman LLP

(57) ABSTRACT

An adjustable dumbbell includes a shaft provided with left- and right-handed threads, two tubes sleeved around and engaging threadedly and respectively the left- and right-handed threads, a hollow grip rod sleeved on the tubes, two support units each having upper and lower support seats disposed above and below one of the tubes, and a plurality of weights each having an engaging hole section engageable with a corresponding tube. Two adjustment knob units are respectively connected to two connecting ends of the shaft to turn the shaft and to thereby move the tubes in opposite directions towards or away from the connecting ends. Each tube is movable between the support seats to selectively engage one or more engaging hole sections of the weights.

8 Claims, 14 Drawing Sheets

ADJUSTABLE DUMBBELL

BACKGROUND OF THE INVENTION

1. Field of the Invention

The invention relates to exercise equipment, more particularly to an adjustable dumbbell.

2. Description of the Related Art

Referring to FIGS. 1 and 2, a conventional adjustable dumbbell 10, as disclosed in U.S. Pat. No. 6,656,093, includes a base 11 for supporting a plurality of weights 12, a rod 13, two latches 14, and two adjustable units 15.

Each of the weights 12 includes a lateral channel 121, and a vertical groove 122 communicating with the lateral channel 121. The lateral channel 121 has a width greater than that of the vertical groove 122.

The rod 13 has two blocks 132 provided respectively on two opposite ends thereof for engaging the vertical grooves 122 of the weights 12, and two conduits 133 laterally and respectively formed in the middle portions of the blocks 132. Each of the blocks 132 includes a passage 135 communicating with the respective conduit 133, and a plurality of spaced-apart apertures 134 communicating with the passage 135. Each of the apertures 134 has a diameter greater than the width of the passage 135.

Each of the latches 14 is inserted slidably into one of the blocks 132 via the corresponding conduit 133, and has a screw hole 141.

Each of the adjustable units 15 is provided at each end of the rod 13, and includes a barrel 151 having a catch 152 provided in a bottom portion thereof for insertion into one of the apertures 134 in the corresponding block 132, a spring 153 disposed in the barrel 151 for biasing the catch 152 to engage one of the apertures 134 and for selectively or adjustably securing the latches 14 to the respective blocks 132, and a bolt 154 passing through the barrel 151 to engage threadedly the screw hole 141 in the corresponding latch 14. The bolt 154 is limited to slide and move along the passage 135 of the corresponding block 132 so that each latch 14 may also be limited to move and slide relative to the respective block 132.

In operation, when the catch 152 of the barrel 151 of each adjustable unit 15 is disengaged from the corresponding aperture 134 by pulling the barrel 151 away from the corresponding block 132 against the spring 153, each latch 14 may be moved and adjusted relative to the corresponding block 132. When each latch 14 is moved to engage the lateral channels 121 of all of the weights 12 on one end of the rod 13, these weights 20 are secured to the corresponding block 132. The number of the weights 12 at each end of the rod 13 can be adjusted by simply moving the latches 14 relative to the blocks 132, respectively.

Although the aforementioned conventional adjustable dumbbell 10 can achieve its intended purpose, the two adjustable units 15 have to be operated separately so as to balance the number of the weights 12 at each end of the rod 13, and the catches 152 of the barrels 151 have to accurately spring back into the corresponding apertures 134 in the blocks 132 when the barrels 151 are released by the user. As a result, adjustment of the conventional adjustable dumbbell 10 is inconvenient and time-consuming.

Referring to FIGS. 3 and 4, another conventional adjustable dumbbell 20 includes a plurality of weights 22 provided on each end of a rod 21, and two adjustable units 23. The user operates the two adjustable units 23 to balance the number of the weights 22 at each end of the rod 21. This conventional adjustable dumbbell 20 similarly has the drawbacks of the aforementioned conventional adjustable dumbbell 10.

SUMMARY OF THE INVENTION

Therefore, the object of the present invention is to provide an adjustable dumbbell that is capable of overcoming the aforementioned drawbacks of the prior art.

According to this invention, an adjustable dumbbell comprises a shaft, two tubes, a hollow grip rod, two support units, and two sets of weights. The shaft includes two opposite connecting ends, an intermediate portion between the connecting ends, and left- and right-handed threads that are formed on the intermediate portion and that are axially spaced apart from each other. The tubes are sleeved around and engage threadedly and respectively the left- and right-handed threads. The hollow grip rod is sleeved on the tubes, and has two opposite engaging portions. Each of the support units has upper and lower support seats disposed above and below one of the tubes. The upper and lower support seats include inner end faces respectively connected to the engaging portions, outer end faces opposite to the inner end faces, and intermediate sections each interconnecting one of the inner end faces and one of the outer end faces and each provided with a plurality of spaced-apart spacers. The weights in each set straddle the upper and lower support seats of one of the support units, and are spaced apart from each other by the spacers. Each of the weights includes a straddling hole that has an engaging hole section engageable with a corresponding one of the tubes. The adjustment knob units are respectively connected to the connecting ends of the shaft to turn the shaft relative to the grip rod and to thereby move the tubes axially of the shaft in opposite directions towards or away from the connecting ends. Each of the tubes is movable between the upper and lower support seats of one of the support units to selectively engage one or more of the engaging hole sections of the weights.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
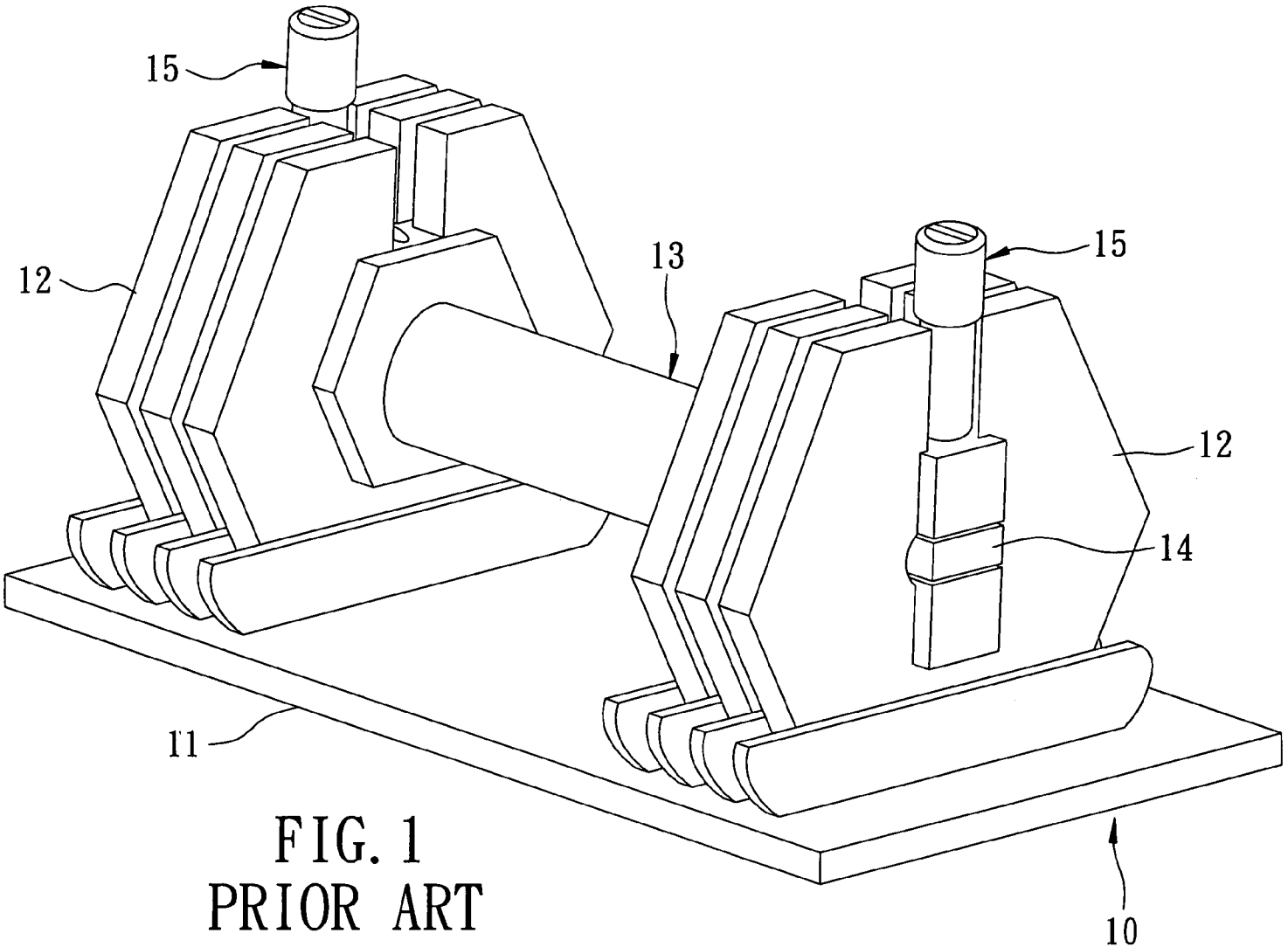
FIG. 1 PRIOR ART
FIG. 1 is a perspective view of a conventional adjustable dumbbell disclosed in U.S. Pat. No. 6,656,093.
Figure 2:
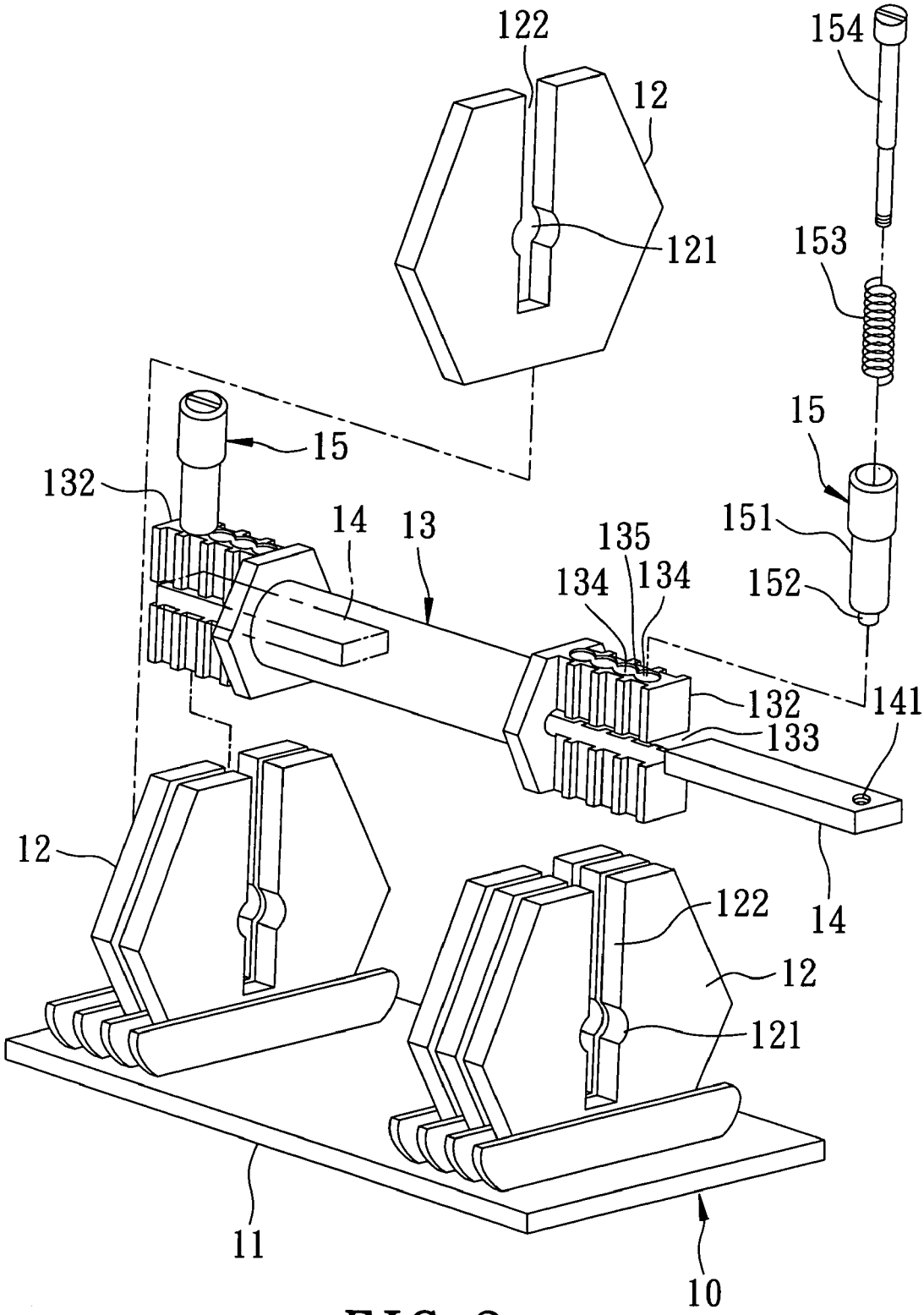
FIG. 2 PRIOR ART
FIG. 2 is a partly exploded perspective view of the conventional adjustable dumbbell of FIG. 1.
Figure 3:
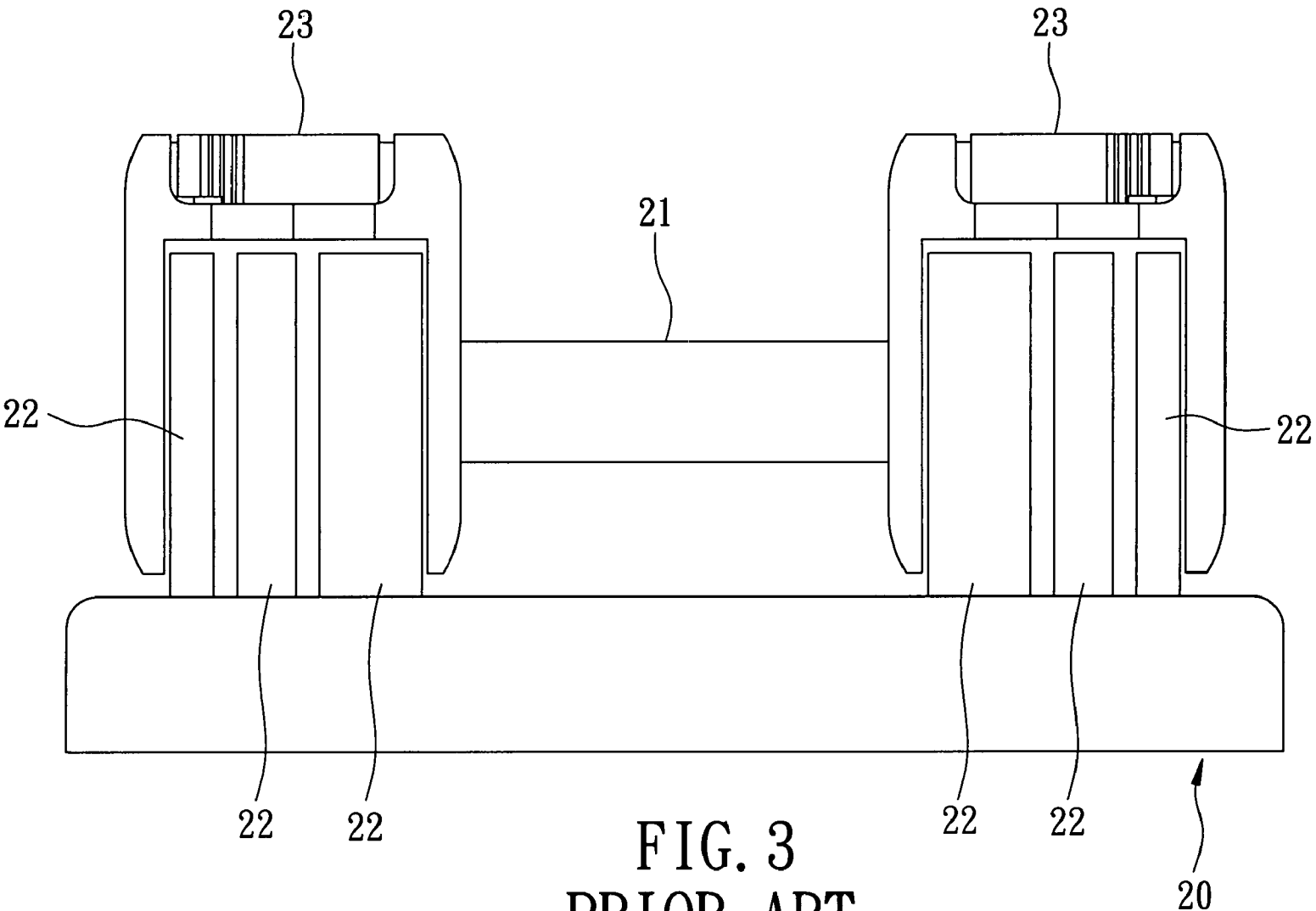
FIG. 3 PRIOR ART
FIG. 3 is a schematic front view of another conventional adjustable dumbbell.
Figure 4:
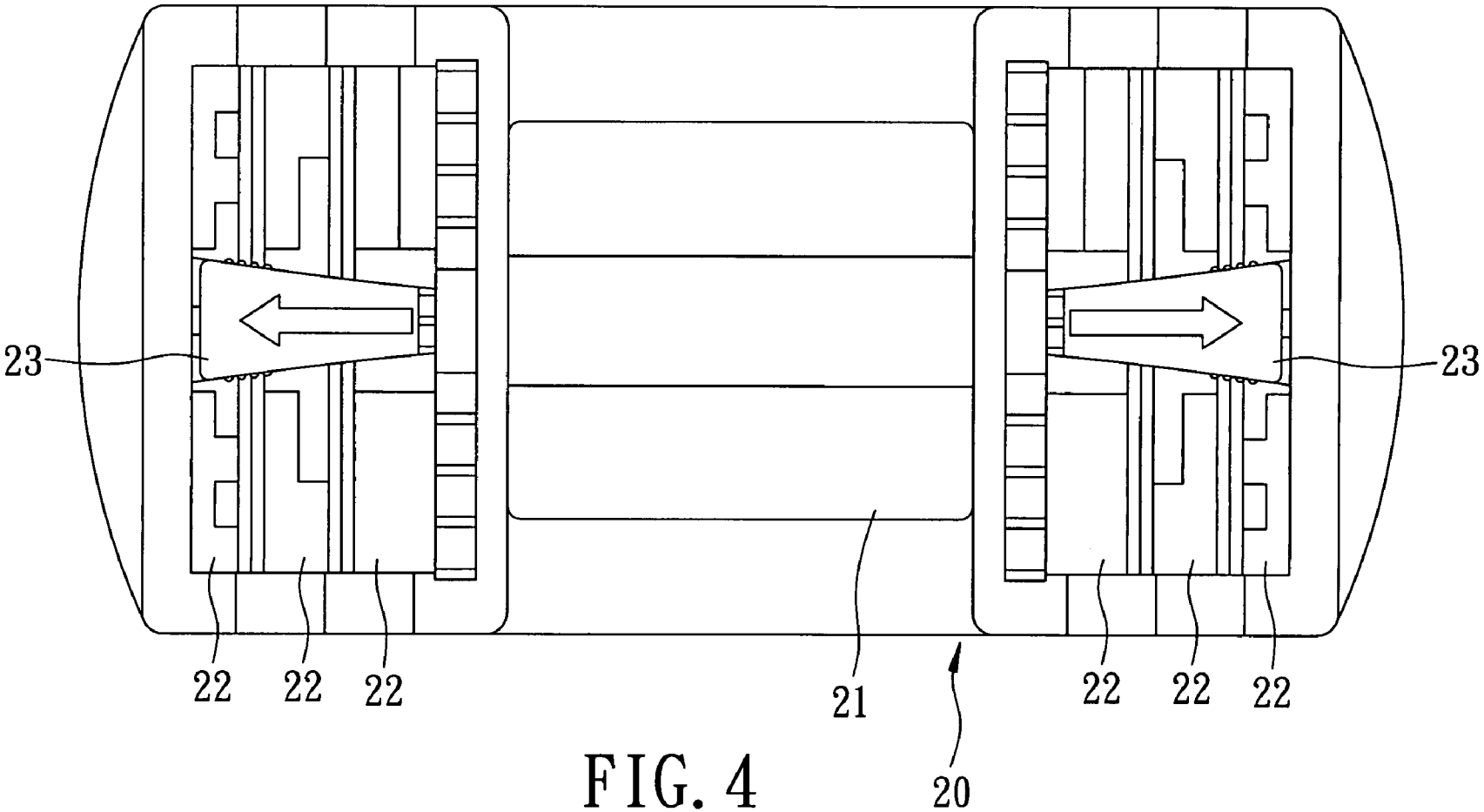
FIG. 4 PRIOR ART
FIG. 4 is a schematic top view of the conventional adjustable dumbbell of FIG. 3.
Figure 5:
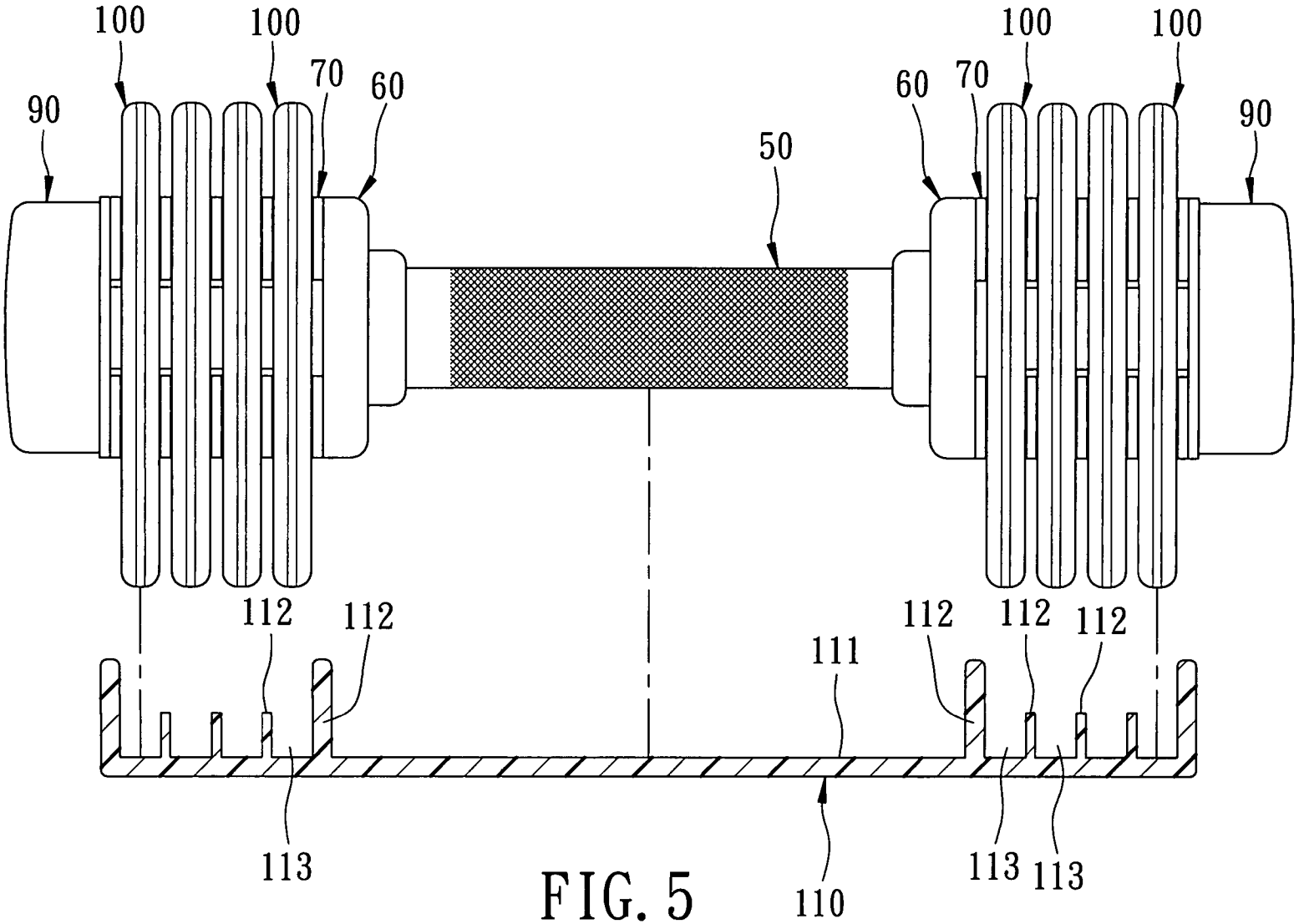
FIG. 5 is a schematic view of the preferred embodiment of an adjustable dumbbell according to the present invention.
Figure 6:
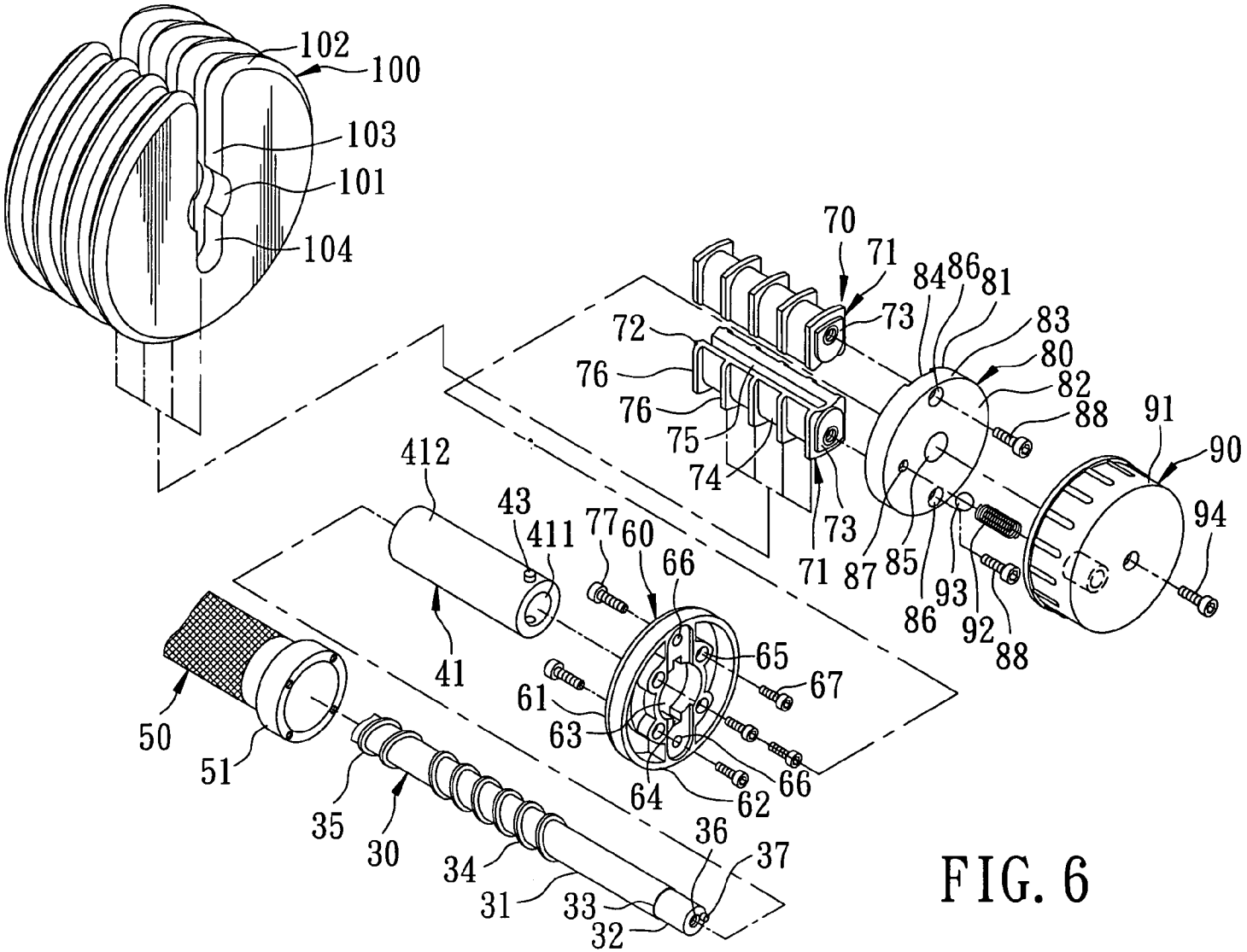
FIG. 6 is a fragmentary exploded perspective view of the preferred embodiment.
Figure 7:
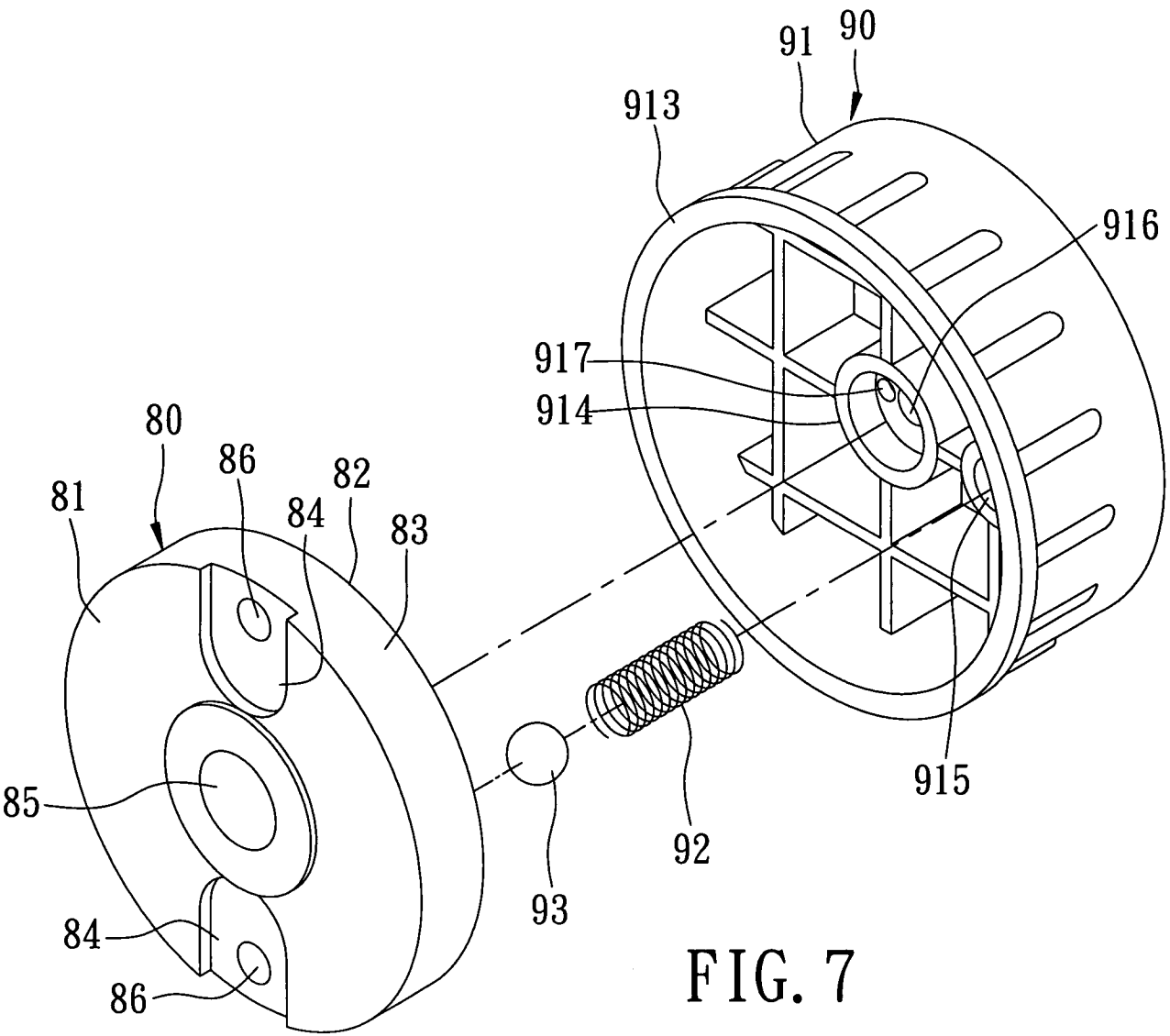
FIG. 7 is an exploded perspective view of an adjustment knob unit of the preferred embodiment.

Referring to FIGS. 5 to 10, the preferred embodiment of an adjustable dumbbell according to the present invention is shown to comprise a shaft 30, two tubes 41, 42, a hollow grip rod 50, two first covers 60, two support units 70, two adjustment knob units 90, two sets of weights 100, and a base 110.

The shaft 30 includes two opposite connecting ends 32, an intermediate portion 31 between the connecting ends 32, two shoulder portions 33 each defined between the intermediate portion 31 and the corresponding connecting end 32, left- and right-handed threads 34, 35 that are formed on the intermediate portion 31 and that are axially spaced apart from each other, two screw holes 36 formed respectively in the connecting ends 32, and two eccentric projections 37 projecting axially, outwardly, and respectively from end faces of the connecting ends 32. The intermediate portion 31 has a diameter larger than those of the connecting ends 32.

The tubes 41, 42 are sleeved around and engage threadedly and respectively the left- and right-handed threads 34, 35 of the shaft 30. The tube 41 includes inner and outer faces 411, 412, and a threaded portion 413 (see FIG. 9) formed in the inner face 411 and engageable with the left-handed thread 34 of the shaft 30. The tube 42 includes inner and outer faces 421, 422, and a threaded portion 423 formed in the inner face 421 and engageable with the right-handed thread 35 of the shaft 30. Each of the tubes 41, 42 further includes two diametrically opposed guide pins 43, 44 projecting outwardly from the outer face 412, 422 of the corresponding tube 41, 42.

The hollow grip rod 50 is sleeved on the outer faces 412, 422 of the tubes 41, 42, and has two opposite engaging portions 51, in the form of discs 51, at two opposite ends thereof, respectively.

The first covers 60 are sleeved slidably and respectively on the tubes 41, 42, and are connected respectively to the engaging portions 51 of the grip rod 50. Each of the first covers 60 includes inner and outer faces 61, 62, a central hole 63 extending axially through the inner and outer faces 61, 62, two diametrically opposed notches 64 extending axially through the inner and outer faces 61, 62 and in spatial communication with the central hole 63, four angularly spaced-apart screw holes 65 extending axially through the inner and outer faces 61, 62 and disposed around the central hole 63, and two diametrically opposed screw holes 66 extending axially through the inner and outer faces 61, 62 and aligning with the notches 64.

In assembly, each first cover 60 is sleeved on the corresponding tube 41, 42 via the central hole 63 such that the inner face 61 abuts against the corresponding engaging portion 51 of the grip rod 50. During this operation, the guide pins 43, 44 of each tube 41, 42 extend through the corresponding first cover 60 via the notches 64. Four bolts 67 are passed respectively through the screw holes 65 so as to engage threadedly the corresponding engaging portion 51 of the grip rod 50, thereby securing each first cover 60 to the corresponding engaging portion 51 of the grip rod 50.

Each of the support units 70 has upper and lower support seats 71 disposed above and below one of the tubes 41, 42. The upper and lower support seats 71 of each support unit 70 include inner end faces 72 respectively connected to and facing the outer face 62 of the corresponding first cover 60, outer end faces 73 opposite to the inner end faces 72, intermediate sections 74 interconnecting the inner and outer end faces 72, 73 and provided with a plurality of spaced-apart spacers 76, and guide grooves 75 extending axially from the inner end face 72 to the outer end face 73.

The guide pins 43, 44 of each tube 41, 42 are received slidably and respectively in the guide grooves 75 of the upper and lower support seats 71 of the corresponding support unit 70 so that axial movement of the tubes 41, 42 relative to the shaft 30 is limited, and rotation of the tubes 41, 42 relative to the shaft 30 is prevented. It should be noted that when the locations of the guide pins 43, 44 and the guide grooves 75 are interchanged, the same result is achieved.

In this embodiment, five spaced-apart spacers 76 are provided on the intermediate sections 74 of the upper and lower support seats 71 of each support unit 70 for supporting four pieces of weights 100. The distance between two adjacent ones of the spacers 76 is equal to one pitch of the left- and right-handed threads 34, 35 of the shaft 30. Thus, when the shaft 30 is turned one revolution, i.e., 360°, the tubes 41, 42 move simultaneously in opposite directions one pitch towards or away the connecting ends 32 of the shaft 30.

During assembly, after the inner end faces 72 of the upper and lower support seats 71 of each support unit 70 are caused to abut against the outer face 62 of the corresponding first cover 60, two bolts 77 are passed respectively through the screw holes 66 so as to engage threadedly and respectively the inner end faces 72 of the upper and lower support seats 71, thereby fastening each support unit 70 to the corresponding first cover 60.

With reference to FIGS. 6, 7, 8, and 10, the adjustment knob units 90 are respectively connected to the connecting ends 32 of the shaft 30 to allow the user to turn the shaft 30 relative to the grip rod 50 and to thereby move the tubes 41, 42 axially of the shaft 30 in opposite directions towards or away from the connecting ends 32 of the shaft 30. Each of thread adjustment knob units 90 includes a second cover 80 and a cap 91. The second cover 80 is sleeved on one of the connecting ends 32 of the shaft 30, and includes opposite inner and outer faces 81, 82, an outer peripheral face 83 interconnecting the inner and outer faces 81, 82, two diametrically opposed cutout portions 84 (see FIG. 7) formed in the inner face 81 for receiving respectively the outer end faces 73 of the upper and lower support seats 71 of the corresponding support unit 70, a through hole 85 extending axially through the inner and outer faces 81, 82 and disposed between the cutout portions 84 for insertion of the corresponding connecting end 32 of the shaft 30 therethrough, two diametrically opposed screw holes 86 extending axially through the inner and outer faces 81, 82 and communicating with the respective cutout portions 84, and a positioning hole 87 formed in the outer face 82 and radially offset from the shaft 30.

After the second cover 80 of each adjustment knob unit 90 is sleeved on the corresponding connecting end 32 of the shaft 30 via the through hole 85 until the inner face 81 abuts against the outer end faces 73 of the upper and lower support seats 71 of the corresponding support unit 70 and the corresponding shoulder portion 33 of the shaft 30, two bolts 88 are passed respectively through the screw holes 86 so as to engage threadedly and respectively the outer end faces 73 of the upper and lower support seats 71 of the corresponding support unit 70, thereby fastening the second cover 80 to the upper and lower support seats 71 of the corresponding support unit 70.

The cap 91 is sleeved rotatably on the second cover 80, and includes a plate section 912, an annular sleeve 913 that extends axially, inwardly, and integrally from an outer periphery of the plate section 912 and that is sleeved on the outer peripheral face 83 of the second cover 80, a tubular protrusion 914 projecting axially and inwardly from the center of the plate section 912, an eccentric socket 915 projecting axially and inwardly from the plate section 912, a central hole 916 formed in the plate section 912 and communicating with the tubular protrusion 914, and a slot 917 formed in the tubular protrusion 914 adjacent to the through hole 916 for receiving the corresponding eccentric projection 37 of the shaft 30.

The cap 91 further includes a spring-loaded detent which has a compression spring 92 disposed in the socket 915, and a roller 93 biased by the spring 92 to engage resiliently the positioning hole 87. The roller 93 has a diameter larger than that of the positioning hole 87 so that the roller 93 can be easily removed from the positioning hole 87.

After the cap 91 is sleeved on the second cover 80, a bolt 94 is passed through the central hole 916 to engage the screw hole 36 in the corresponding connecting end 32 of the shaft 30, so that the cap 91 and the second cover 80 are secured to the shaft 30.

It should be noted that when one of the projections 37 of the shaft 30 is inserted into the slot 917 in the cap 91, the roller 93 projects into the positioning hole 87 so as to enhance alignment and assembly.

There are four of the weights 100 in each set thereof. Each of the weights 100 includes a straddling hole that has an engaging hole section 101 engageable with the corresponding tube 41, 42, a long hole section 103 extending radially and outwardly from the engaging hole section 101 and through an outer peripheral face 102 of the weight 100, and a short hole section 104 extending radially and outwardly from the engaging hole section 101 opposite to the long hole section 103. Each of the long and short hole sections 103, 104 has a width smaller than a width of the engaging hole section 101. Through the presence of the long and short hole sections 103, 104, each set of the weights 100 can be straddled on the upper and lower support seats 71 of one of the support units 70. At this time, the weights 100 in each set are spaced apart from each other by the spacers 76. Each of the weights 100 is prevented from moving axially by two adjacent ones of the spacers 76 of the upper and lower support seats 71. Each of the tubes 41, 42 is movable between the upper and lower seats 71 of one of the support units 70 to selectively engage one or more of the engaging hole sections 101 of the weights 100.

The base 110 (see FIG. 5) includes a plurality of spaced-apart retainers 112 projecting upwardly and integrally from a top face 111 thereof. The distance between two adjacent ones of the retainers 112 is equal to the distance between two adjacent ones of the spacers 76. Each two adjacent ones of the retainers 112 cooperate with the top face 111 to define a receiving space 113 for receiving a corresponding one of the weights 100.

Figure 8:
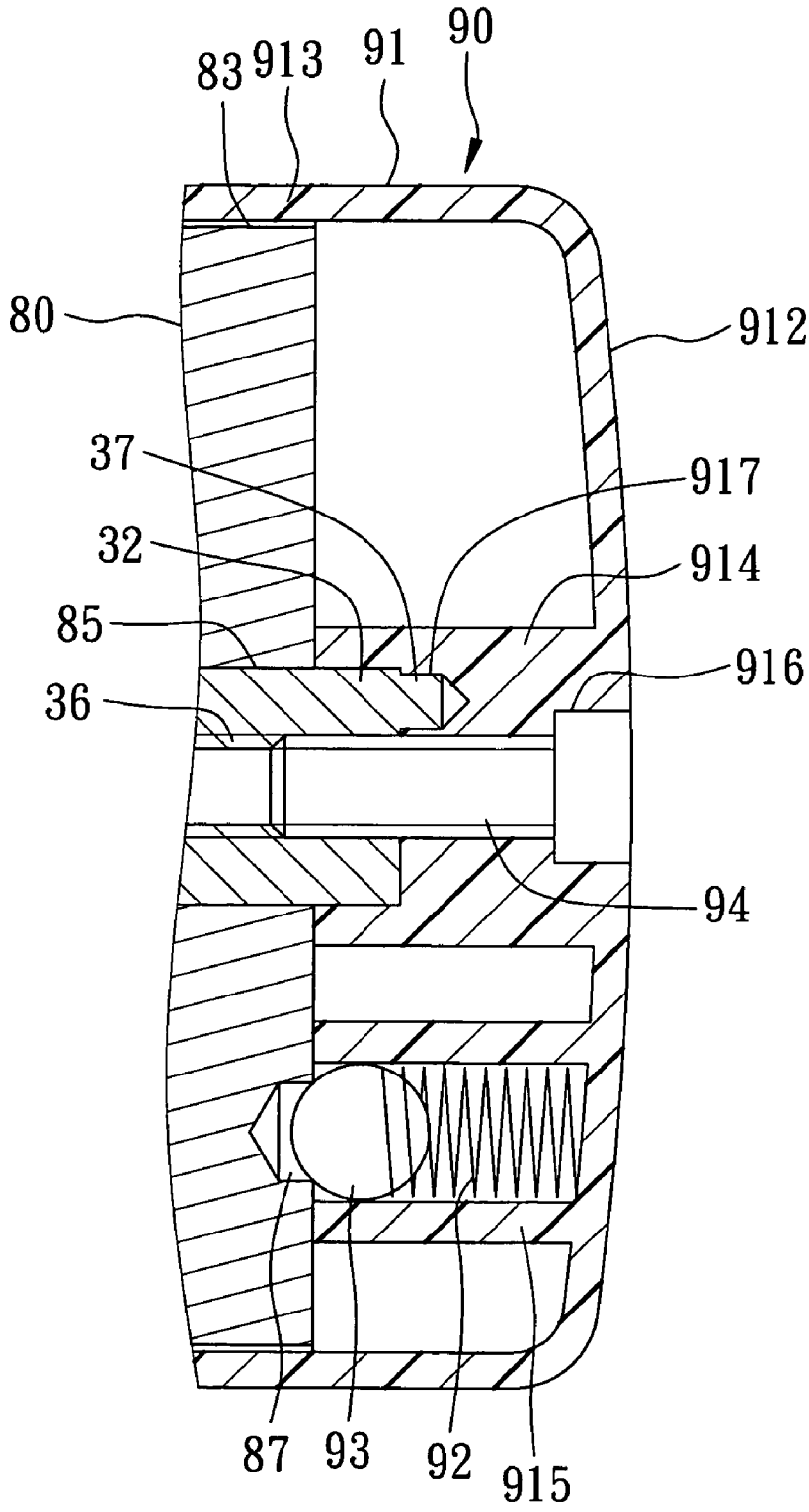
FIG. 8 is a fragmentary sectional view of the adjustment knob unit of the preferred embodiment in an assembled state.
Figure 9:
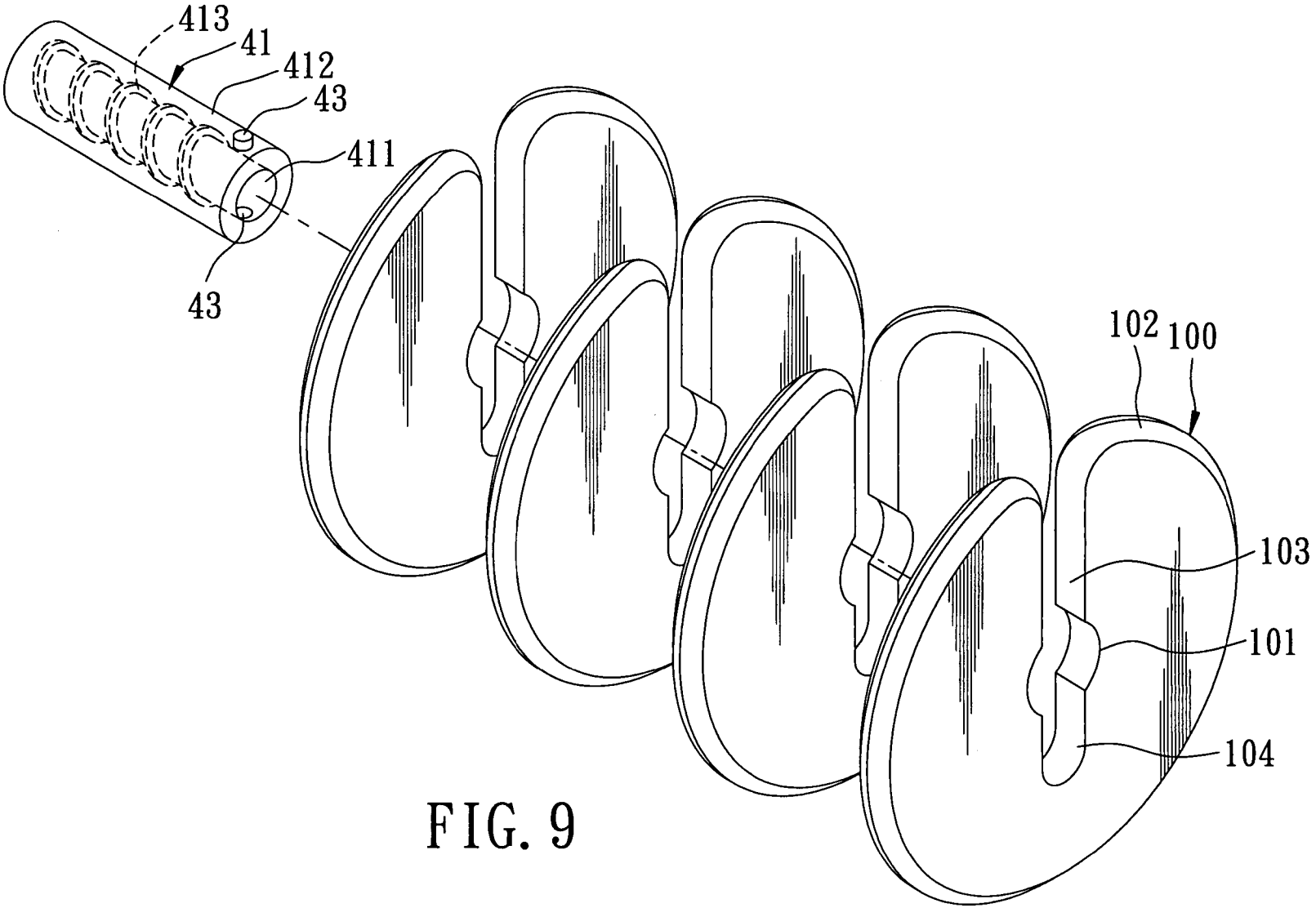
FIG. 9 is a partly exploded perspective view of the preferred embodiment, illustrating how a tube can engage engaging hole sections of a plurality of weights.

Each weight 100 is typically received in the corresponding receiving space 113 in the base 110 with the long hole section 103 facing upwardly, and the roller 93 is projected into the positioning hole 87 (see FIG. 8). When the user desires to adjust the weight of the dumbbell of the present invention, he/she simply rotates the cap 91 of one of the adjustment knob units 90.

Figure 10:
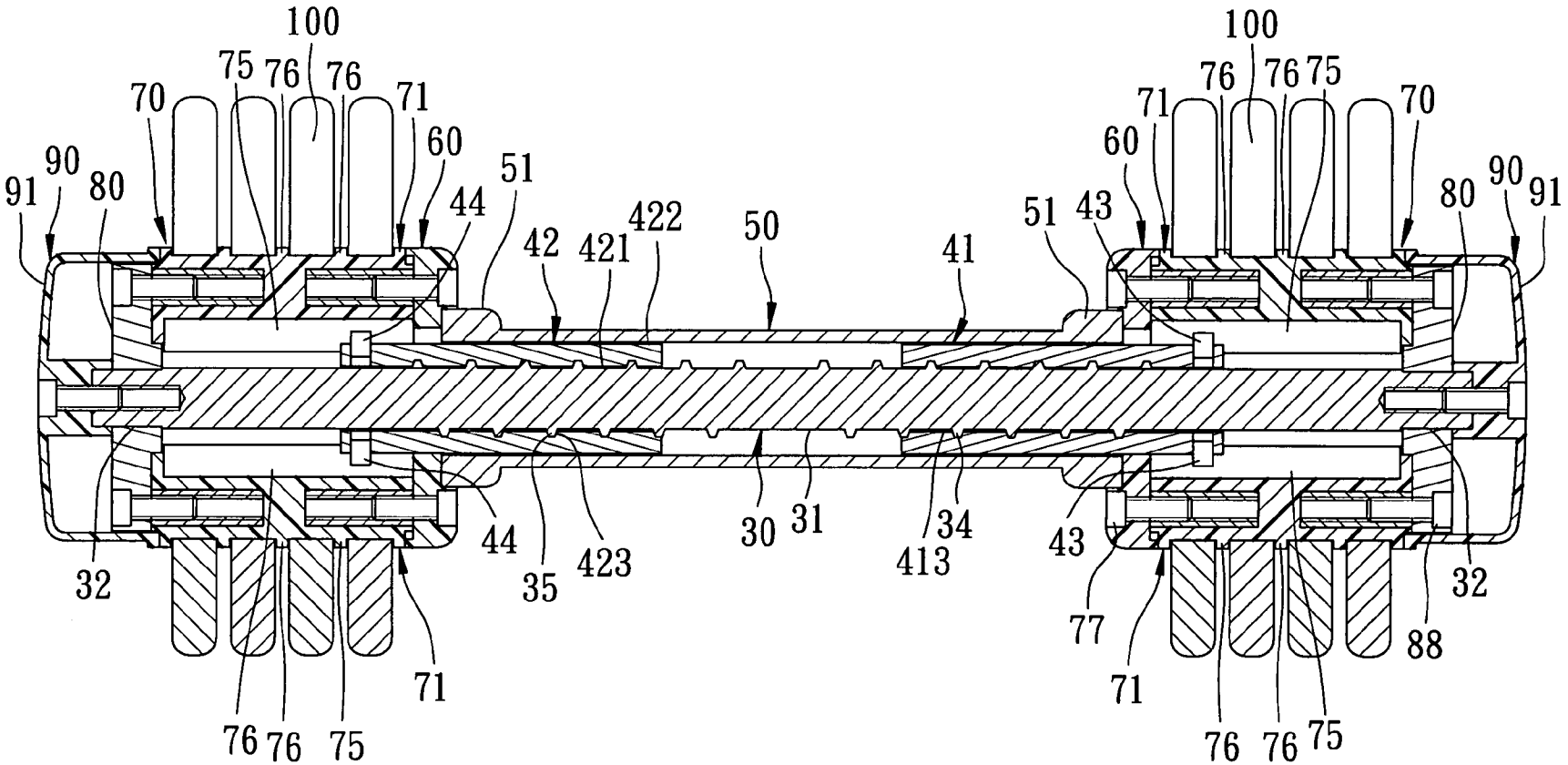
FIG. 10 is a sectional view of the preferred embodiment in an assembled state.

Referring to FIG. 10, if each tube 41, 42 is engaged to the engaging hole section 101 of only one of the weights 100 in each set, when the user grasps and lifts the grip rod 50 of the dumbbell, only one of the weights 100 in each set is carried away by the corresponding support unit 70. The rest of the weights 100 remain on the base 110.

Figure 11:
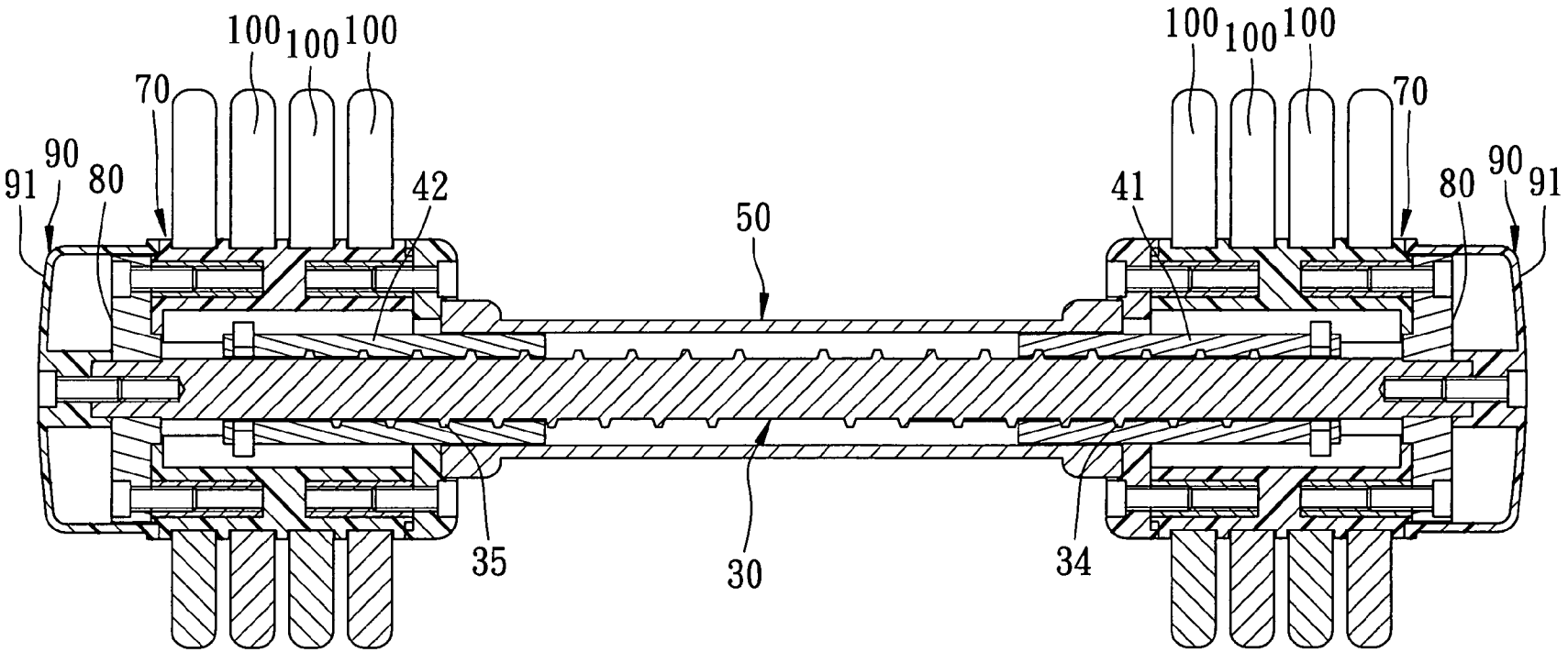
FIG. 11 is a view similar to FIG. 10, but with two tubes in another position.
Figure 12:
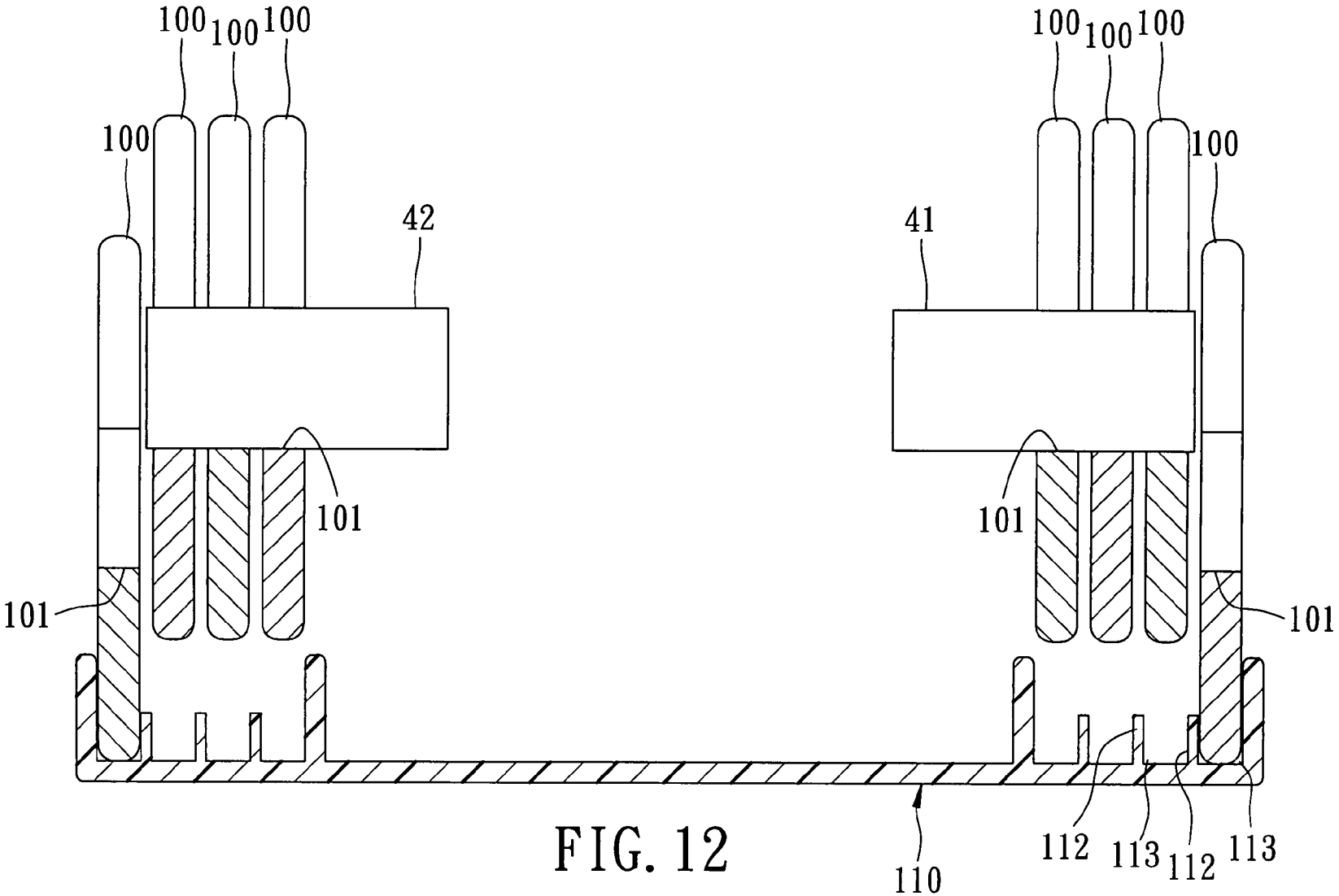
FIG. 12 is a sectional front view of the preferred embodiment, illustrating each tube supporting three pieces of weights.

Referring to FIGS. 11 and 12, in combination with FIG. 10, to increase the number of the weights 100 on each side of the dumbbell of the present invention, the cap 91 of one of the adjustment knob units 90 is rotated in a clockwise direction. As an example, the cap 91 of one of the adjustment knob units 90 may be rotated clockwise two turns, so as to similarly rotate the shaft 30 two turns in the clockwise direction. This will result in each tube 41, 42 moving simultaneously two pitches toward the respective connecting ends 32 of the shaft 30 and thereby engaging the engaging hole sections 101 of three of the weights 100 in each set. Hence, when the user grasps and lifts the grip rod 50 of the dumbbell of the present invention, three of the weights 100 in each set are carried away by the corresponding support unit 70, while the other weights 100 are left remaining on the base 110.

Figure 13:
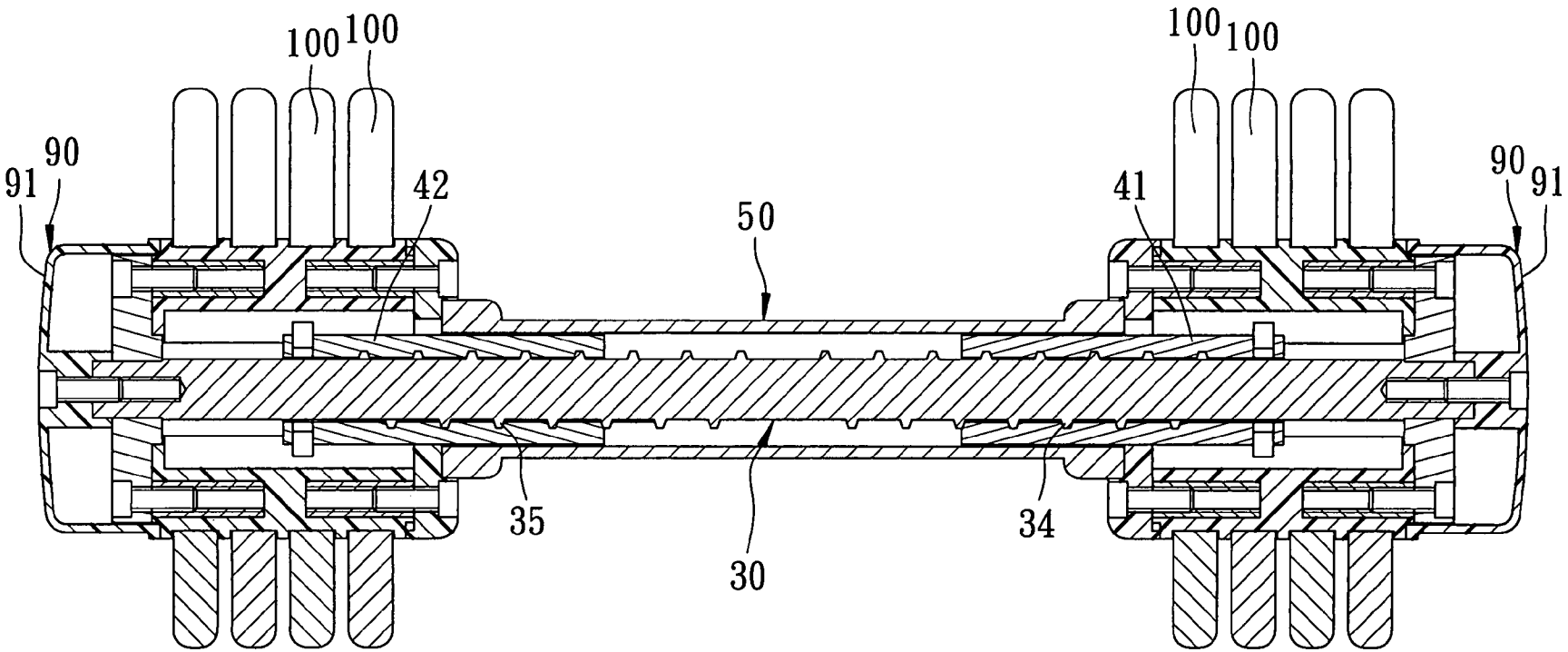
FIG. 13 is a view similar to FIG. 10, but with the tubes in still another position.
Figure 14:
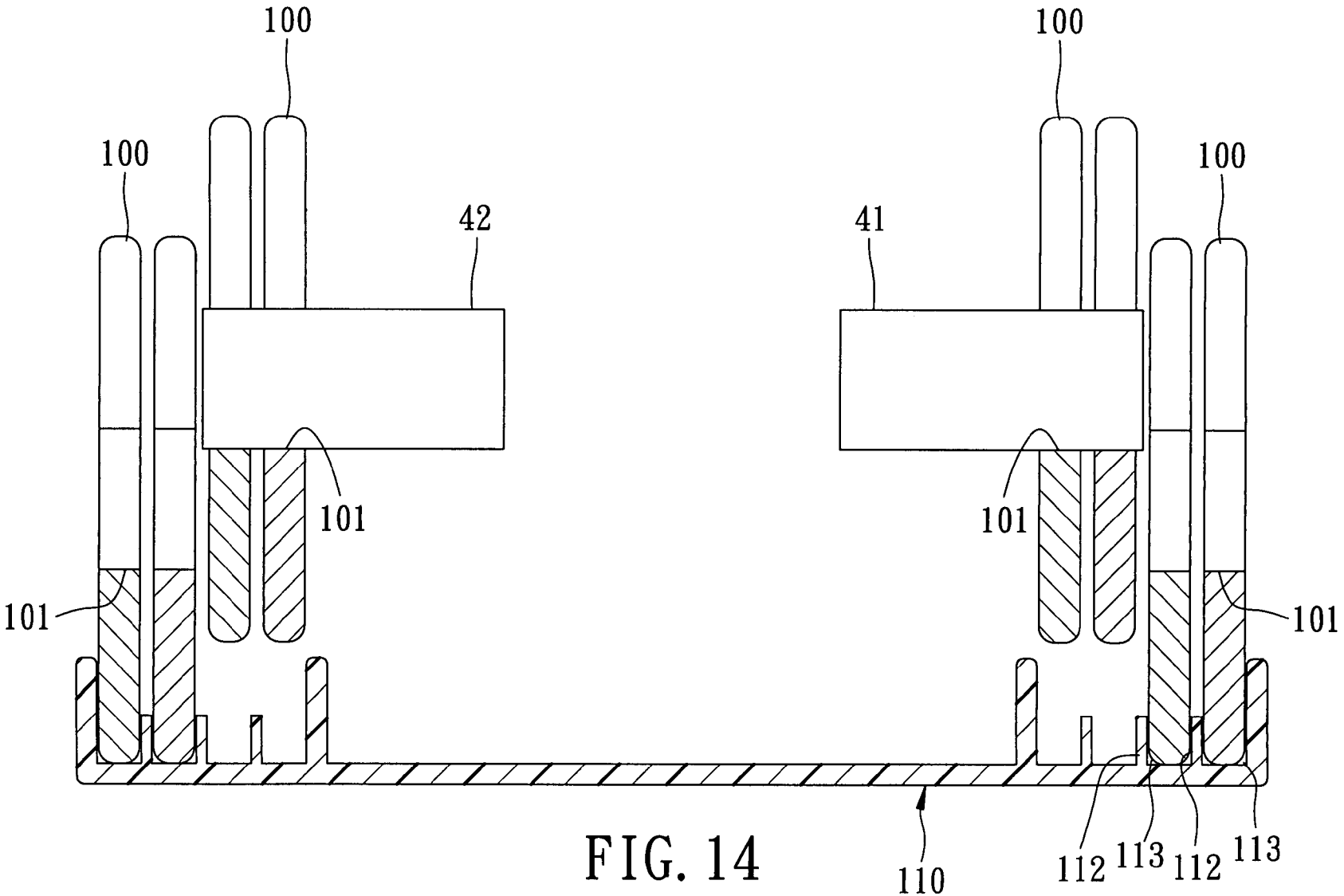
FIG. 14 is a view similar to FIG. 12, but with each tube supporting two pieces of weights.

Referring to FIGS. 13 and 14, in combination with FIG. 11, to reduce the number of weights 100 on each side of the dumbbell of the present invention, the cap 91 of one of the adjustment knob units 90 is rotated in a counterclockwise direction. For example, if the cap 91 of one of the adjustment knob units 90 is rotated by one turn, the shaft 30 is similarly rotated one turn also in the counterclockwise direction. This will result in each tube 41, 42 moving simultaneously one pitch toward the grip rod 50 and away from the respective connecting ends 32 of the shaft 30, thereby engaging the engaging hole sections 101 of two of the weights 100 in each set. Hence, when the user grasps and lifts the grip rod 50 of the dumbbell of the present invention, only two of the weights 100 in each set are carried away by the corresponding support unit 70, while the other weights 100 are left remaining on the base 110.

It should be noted that during rotation of the cap 91, the roller 93 is moved away from the positioning hole 87, and abuts against the outer face 82 of the second cover 80, thereby compressing the spring 92. After the cap 91 has turned one revolution, the roller 93 is pushed by the restoring force of the spring 92 to extend back into the positioning hole 87. This returning of the roller 93 back into the positioning hole 87 may be perceived by the user to thereby let the user know that the cap 91 has turned one revolution, and the number of the weights 100 on each side of the dumbbell of the present invention has been reduced or increased by one.

From the aforementioned description, the advantages of the adjustable dumbbell of the present invention may be summarized as follows:

1. Rotation of the cap 91 of one of the adjustment knob units 90 can permit each tube 41, 42 to move toward or away from the corresponding connecting end 32 of the shaft 30 so as to selectively engage one or more of the engaging hole sections 101 of the weights 100. Hence, the weight on each side of the dumbbell of the present invention can be adjusted easily and quickly.

2. Through coordination of the positioning hole 87 in the second cover 80 and the spring-loaded detent of the cap 91, the user is able to sensually perceive the number of turns the cap 91 has rotated and therefore the number of the weights 100 supported by each support unit 70.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An adjustable dumbbell comprising:

a shaft including two opposite connecting ends, an intermediate portion between said connecting ends, and left- and right-handed threads that are formed on said intermediate portion and that are axially spaced apart from each other;

two tubes sleeved around and engaging threadedly and respectively said left- and right-handed threads;

a hollow grip rod sleeved on said tubes and having two opposite engaging portions;

two support units each having upper and lower support seats disposed above and below one of said tubes, said upper and lower support seats including inner end faces respectively connected to said engaging portions, outer end faces opposite to said inner end faces, and intermediate sections each interconnecting one of said inner end faces and one of said outer end faces and each provided with a plurality of spaced-apart spacers;

two sets of weights, said weights in each set straddling said upper and lower support seats of one of said support units and being spaced apart from each other by said spacers, each of said weights including a straddling hole that has an engaging hole section engageable with a corresponding one of said tubes; and two adjustment knob units respectively connected to said connecting ends of said shaft to turn said shaft relative to said grip rod and to thereby move said tubes axially of said shaft in opposite directions towards or away from said connecting ends;

each of said tubes being movable between said upper and lower support seats of one of said support units to selectively engage one or more of said engaging hole sections of said weights.

2. The adjustable dumbbell of claim 1, further comprising two first covers sleeved slidably and respectively on said tubes and connected respectively to said engaging portions of said grip rod, said inner end faces of said upper and lower support seats of one of said support units being respectively connected to said first covers.

3. The adjustable dumbbell of claim 1, wherein each of said adjustment knob units includes a second cover sleeved on one of said connecting ends of said shaft and connected to said outer end faces of said upper and lower support seats of one of said support units, and a cap receiving said second cover and connected to said one of said connecting ends, said second cover having an inner face abutting against said outer end faces of said upper and lower support seats of one of said support units, and an outer face opposite to said inner face.

4. The adjustable dumbbell of claim 3, wherein said second cover further has a positioning hole formed in said outer face of said second cover and radially offset from said shaft, said cap including a spring-loaded detent mounted on said cap and biased to engage resiliently said positioning hole.

5. The adjustable dumbbell of claim 3, wherein each of said adjustment knob units further includes a slot provided in said cap, said shaft further including two eccentric projections projecting outwardly, axially, and respectively from end faces of said connecting ends of said shaft and fitted respectively into said slots in said adjustment knob units.

6. The adjustable dumbbell of claim 1, wherein the distance between two adjacent ones of said spacers is equal to one pitch of said left- and right-handed threads.

7. The adjustable dumbbell of claim 1, wherein each of said tubes includes two diametrically opposed guide pins, said upper and lower support seats of each of said support units further including axially extending guide grooves, respectively, for receiving slidably and respectively said guide pins.

8. The adjustable dumbbell of claim 1, wherein said intermediate portion of said shaft is larger in diameter than said connecting ends, said shaft further including two shoulder portions each defined between said intermediate portion and a corresponding one of said connecting ends, said shoulder portions respectively a butting against said second covers.

* * * * *

UNITED STATES PATENT AND TRADEMARK OFFICE

CERTIFICATE OF CORRECTION

PATENT NO. : 7,413,533 B2
APPLICATION NO. : 11/350169
DATED : August 19, 2008
INVENTOR(S) : William Lin It is certified that error appears in the above-identified patent and that said Letters Patent is hereby corrected as shown below:

On the title page, item [73] Assignee:

Delete "ASAI" and insert -- ASIA -- therefor.

Signed and Sealed this

Tenth Day of February, 2009

JOHN DOLL
*Acting Director of the United States Patent and Trademark Office*